US009778617B2

(12) United States Patent
Moon et al.

(10) Patent No.: US 9,778,617 B2
(45) Date of Patent: Oct. 3, 2017

(54) PROCESS CARTRIDGE HAVING FIXED AND MOVEABLE ELECTRIC CONTACTS AND ELECTRO-PHOTOGRAPHIC IMAGE FORMING APPARATUS USING THE PROCESS CARTRIDGE

(71) Applicant: Samsung Electronics Co., Ltd., Suwon-si (KR)

(72) Inventors: Ji-won Moon, Anyang-si (KR); Seung-gweon Lee, Suwon-si (KR); Joon-hee Kim, Seoul (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/270,716

(22) Filed: Sep. 20, 2016

(65) Prior Publication Data

US 2017/0185034 A1 Jun. 29, 2017

(30) Foreign Application Priority Data

Dec. 28, 2015 (KR) ..... 10-2015-0187632

(51) Int. Cl.
*G03G 15/00* (2006.01)
*G03G 21/18* (2006.01)

(52) U.S. Cl.
CPC ..... *G03G 21/1867* (2013.01)

(58) Field of Classification Search
CPC ..... G03G 21/1867
USPC ..... 399/90
See application file for complete search history.

(56) References Cited

U.S. PATENT DOCUMENTS

| | | | | |
|---|---|---|---|---|
| 7,248,810 | B2 | 7/2007 | Miyabe et al. | |
| 7,266,321 | B2 | 9/2007 | Ahn et al. | |
| 7,536,130 | B2 | 5/2009 | Yokoi | |
| 7,813,666 | B2 | 10/2010 | Sato | |
| 8,682,200 | B2 * | 3/2014 | Chadani et al. ... | G03G 21/1871 399/90 |
| 8,843,012 | B2 * | 9/2014 | Maeda et al. ..... | G03G 21/1867 399/90 |
| 8,971,728 | B2 * | 3/2015 | Itabashi et al. .... | G03G 21/1867 399/90 |

(Continued)

FOREIGN PATENT DOCUMENTS

| | | |
|---|---|---|
| EP | 2 574 990 A2 | 4/2013 |
| JP | 3-50715 | 5/1991 |

(Continued)

OTHER PUBLICATIONS

International Search Report dated Nov. 29, 2016 in corresponding International Patent Application No. PCT/KR2016/010460.

(Continued)

*Primary Examiner* — William J Royer
(74) *Attorney, Agent, or Firm* — Staas & Halsey LLP

(57) ABSTRACT

Provided is a process cartridge attachable to and detachable from a main body of an image forming apparatus. The process cartridge includes at least one roller, sidewalls on an axial direction of the at least one roller, and a first cartridge electric contact and a second cartridge electric contact provided on the sidewalls. One of the first cartridge electric contact and the second cartridge electric contact is a fixed electric contact, and the other is a movable electric contact that is movable in a direction protruding from the sidewalls.

20 Claims, 9 Drawing Sheets

(56) References Cited

U.S. PATENT DOCUMENTS

| | | | |
|---|---|---|---|
| 9,188,944 | B2 | 11/2015 | Park et al. |
| 9,195,202 | B2 | 11/2015 | Choi |
| 9,229,421 | B2 | 1/2016 | Choi et al. |

FOREIGN PATENT DOCUMENTS

| | | |
|---|---|---|
| JP | 2000-181325 | 6/2000 |
| JP | 2006-91652 | 4/2006 |
| JP | 2008-185825 | 8/2008 |
| JP | 4483805 | 4/2010 |
| JP | 2015-125278 | 7/2015 |
| KR | 10-0461588 | 12/2004 |
| KR | 10-0474428 | 2/2005 |
| KR | 10-2013-0011251 | 1/2013 |
| KR | 10-2013-0051812 | 5/2013 |
| KR | 10-2014-0052522 | 5/2014 |

OTHER PUBLICATIONS

Korean Office Action dated Dec. 20, 2016 in corresponding Korean Patent Application No. 10-2015-0187632.
European Search Report dated Jun. 2, 2017 in corresponding European Patent Application No. 16190690.4.
European Office Action dated Jun. 23, 2017 in corresponding European Patent Application No. 16190690.4.

* cited by examiner

PROCESS CARTRIDGE HAVING FIXED AND MOVEABLE ELECTRIC CONTACTS AND ELECTRO-PHOTOGRAPHIC IMAGE FORMING APPARATUS USING THE PROCESS CARTRIDGE

CROSS-REFERENCE TO RELATED APPLICATION

This application claims the benefit of Korean Patent Application No. 10-2015-0187632, filed on Dec. 28, 2015, in the Korean Intellectual Property Office, the disclosure of which is incorporated herein in its entirety by reference.

BACKGROUND

1. Field

The present disclosure relates to an electro-photographic image forming apparatus and a process cartridge attachable to or detachable from the electro-photographic image forming apparatus.

2. Description of the Related Art

An image forming apparatus using an electro-photographic scheme supplies a toner to a latent image formed on a photoconductor to form a visible toner image on the photoconductor, transfers the toner image to a recording medium, and fixes the transferred toner image onto the recording medium to print an image onto the recording medium.

A process cartridge is an assembly of parts for forming the visible toner image and is attachable to or detachable from a main body of the image forming apparatus. Once being mounted on the main body, the process cartridge is electrically connected with the main body. To this end, an electric contact connected with an electricity supply unit positioned on the main body is provided on a side of the process cartridge. The electricity supply unit and the electric contact receive contact pressure. The contact pressure has an influence on position stability of the process cartridge in the main body.

When the process cartridge is attached to or detached from the main body, interference may occur between the electricity supply unit provided on the main body and the process cartridge or between the electric contact and the main body. This interference may cause noise during the attachment or detachment and a contact failure between the electric contact and the electricity supply unit due to abrasion of the electricity supply unit or the electric contact.

SUMMARY

Provided are a process cartridge having an electric connection structure for maintaining position stability of the process cartridge and an electro-photographic image forming apparatus using the process cartridge.

Provided are a process cartridge for reducing interference between electric contacts of the process cartridge and a main body of an electro-photographic image forming apparatus and an electro-photographic image forming apparatus using the process cartridge.

Additional aspects will be set forth in part in the description which follows and, in part, will be apparent from the description, or may be learned by practice of the presented embodiments.

According to an aspect of an embodiment, a process cartridge attachable to and detachable from an image forming apparatus includes, a roller, a sidewall disposed on an axial direction of the roller, a first cartridge electric contact provided on the sidewall, and a second cartridge electric contact provided on the sidewall, wherein one of the first cartridge electric contact and the second cartridge electric contact is a fixed electric contact, and the other of the first cartridge electric contact and the second cartridge electric contact is a movable electric contact that is movable in a direction in which the other of the first cartridge electric contact and the second cartridge electric contact protrudes from the sidewall.

The first cartridge electric contact and the second cartridge electric contact may be positioned on a front end portion and a rear end portion of the sidewall, respectively, along a mounting direction of the process cartridge into the image forming apparatus.

The first cartridge electric contact may be the fixed electric contact and the second cartridge electric contact may be the movable electric contact.

The first cartridge electric contact may be insertable into a guide rail provided on a main body of the image forming apparatus to guide attachment or detachment of the process cartridge to the image forming apparatus.

A first guide protrusion and a second guide protrusion may be provided on the front end portion and the rear end portion of the sidewall, respectively, so as the process cartridge to be insertable into the guide rail provided on the main body, and the first cartridge electric contact and the second cartridge electric contact may be provided on the first guide protrusion and the second guide protrusion, respectively.

The movable electric contact may be elastically biased by an elastic force in the direction in which the movable electric contact protrudes from the sidewall.

The movable electric contact may protrude from the sidewall by a magnetic force.

The roller may include a photosensitive drum on which an electrostatic latent image is formed. The roller may further include a developing roller that supplies a toner to the electrostatic latent image. The cartridge may include a mounting portion and a developing cartridge including the developing roller, and the developing cartridge may be attachable to and detachable from the mounting portion.

The roller may include a developing roller to supply a toner from the process cartridge to an electrostatic latent image formed on a photosenstive drum of the image forming apparatus.

According to an aspect of another embodiment, a process cartridge attachable to and detachable from an image forming apparatus includes a roller, a sidewall disposed on an axial direction of the roller, a first guide protrusion and a second guide protrusion provided on a front end portion and a rear end portion of the sidewall, respectively, and insertable into a guide rail provided on the image forming apparatus, a first cartridge electric contact provided in the first guide protrusion, and a second cartridge electric contact provided in the second guide protrusion, wherein the first cartridge electric contact is a fixed electric contact, and the second cartridge electric contact is a movable electric contact that is movable in a direction in which the second cartridge electric contact protrudes from the sidewall.

The process cartridge may further include an elastic member elastically biasing the second cartridge electric contact in the direction in which the second cartridge electric contact protrudes from the sidewall.

The second cartridge electric contact may include a magnetic body drawn by a magnetic force to thereby cause the second cartridge electric contact to protrude from the sidewall.

The roller may include a photosensitive drum on which an electrostatic latent image is formed. The roller may further include a developing roller that supplies a toner to the electrostatic latent image. The cartridge may include a mounting portion and a developing cartridge including the developing roller, and the developing cartridge may be attachable to and detachable from the mounting portion.

The roller may include a developing roller to supply a toner from the process cartridge to an electrostatic latent image formed on a photosensitive drum of the image forming apparatus.

According to an aspect of another embodiment, an electro-photographic image forming apparatus includes a main body including a first set electric contact and a second set electric contact, and the above-mentioned process cartridge that is attachable to and detachable from the main body, in which when the process cartridge is attached to the main body, the first cartridge electric contact and the second cartridge electric contact contact the first set electric contact and the second set electric contact, respectively.

The first and second set electric contacts and the first and second cartridge electric contacts may be paired as the fixed electric contact and the movable electric contact or as the fixed electric contact and the movable electric contact.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
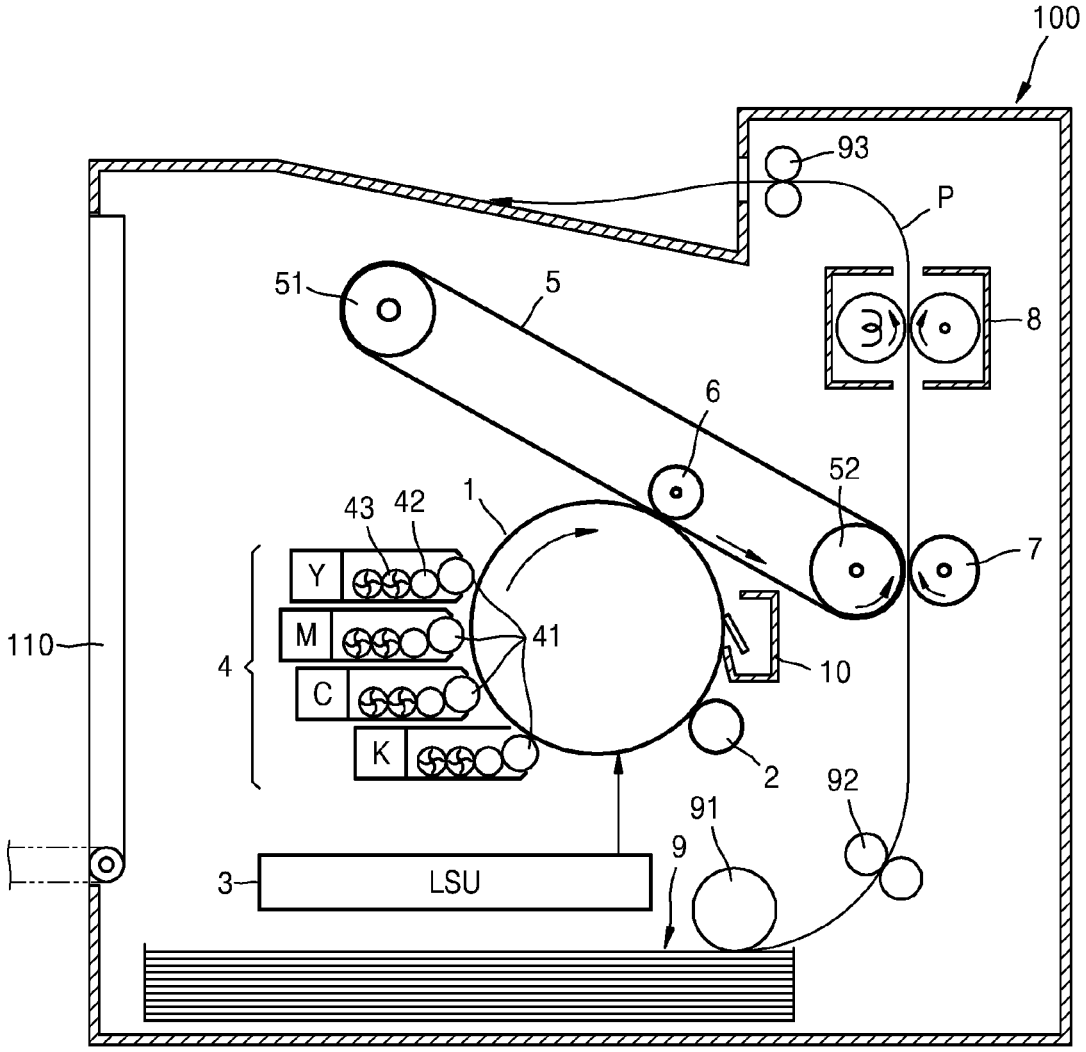
FIG. 1 is a schematic diagram of an electro-photographic image forming apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

Hereinafter, embodiments of the present disclosure will be described with reference to the accompanying drawings. Throughout the specification and drawings, elements substantially having identical functions will be indicated by identical reference numerals to avoid repetitive description.

FIG. 1 is a schematic diagram of an electro-photographic image forming apparatus according to an embodiment. Referring to FIG. 1, the image forming apparatus may include a photosensitive drum 1, a charging roller 2, an exposurer 3, a process cartridge 4, an intermediate transfer roller 6, a transfer roller 7, and a fixer 8.

The photosensitive drum 1 has a photoconductive layer formed on a circumference of a cylindrical metallic drum. The charging roller 2 is an example of a charger that charges the photosensitive drum 1 to a uniform potential. The charging roller 2 supplies electric charges while rotating in contact with or in non-contact with an outer circumferential surface of the photosensitive drum 1, thus charging the outer circumferential surface of the photosensitive drum 1 to a uniform potential. A corona discharger (not shown) instead of the charging roller 2 may be used as a charger. The exposurer 3 forms an electrostatic latent image by scanning light corresponding to image information onto the photosensitive drum 1 charged to have a uniform potential. As the exposurer 3, a laser scanning unit (LSU) using a laser diode as a light source is generally used.

The image forming apparatus according to the current embodiment uses a toner in cyan (C), magenta (M), yellow (Y), and black (K). Hereinbelow, when each element needs to be identified according to color, the element will be identified by Y, M, C, or K added after a reference numeral indicating the element.

The image forming apparatus according to the current embodiment may include four process cartridges 4Y, 4M, 4C, and 4K for developing an electrostatic latent image formed on the photosensitive drum 1 by using the toner received therein. The process cartridge 4 may include a developing roller 41. The process cartridge 4 is positioned such that the developing roller 41 maintains a developing gap with the photosensitive drum 1. The developing gap may be several tens of through several hundreds of micron in size. A developing bias voltage for supplying the toner to the photosensitive drum 1 is applied to the developing roller 41. A supply bias voltage for supplying the toner received in the process cartridge 4 to the developing roller 41 is applied to a supply roller 42. Reference numeral 43 is a stirrer that stirs the toner in the process cartridge 4 and delivers the stirred toner toward the supply roller 42. Although not shown in the drawings, the process cartridge 4 may further include a restriction member to restrict the amount of the toner that is attached to a surface of the developing roller 41.

In a multi-path color image forming apparatus, the plurality of process cartridges 4 operate sequentially. The developing bias is applied to the developing roller 41 of a selected process cartridge (e.g., 4Y), and the developing bias may not be applied to the developing rollers 41 of the other process cartridges (e.g., 4M, 4C, and 4K) or an anti-developing bias for preventing development of the toner may be applied to the developing rollers 41 of the other process cartridges 4. The developing roller 41 of the selected process cartridge (e.g., 4Y) may rotate, and the developing rollers 41 of the other process cartridges (e.g., 4M, 4C, and 4K) may not rotate.

An intermediate transfer belt 5 is supported by support rollers 51 and 52, and thus runs at the same running linear speed as a rotating linear speed of the photosensitive drum 1. A length of the intermediate transfer belt 5 is equal to or at least longer than a length of maximum-size paper P used for the image forming apparatus. The intermediate transfer roller 6 faces the photosensitive drum 1, and an intermediate transfer bias voltage for transferring a toner image developed on the photosensitive drum 1 to the intermediate transfer belt 5 is applied to the intermediate transfer roller 6. The transfer roller 7 is installed to face the intermediate transfer belt 5. The transfer roller 7 is spaced apart from the intermediate transfer belt 5 when the toner image is transferred to the intermediate transfer belt 5 from the photosensitive drum 1. Once the toner image is completely transferred to the intermediate transfer belt 5, the transfer roller 7 contacts the intermediate transfer belt 5 at a predetermined pressure. The transfer bias voltage for transferring the toner image to the paper P is applied to the transfer roller 7. A cleaning means 10 removes the toner remaining on the photosensitive drum 1 after the transfer of the toner image.

An image forming process based on the above-described structure will be described in brief. The light corresponding to image information of, for example, yellow (Y) is irradiated from the exposurer 3 to the photosensitive drum 1 charged to a uniform potential by the charging roller 2. On the photosensitive drum 1 is formed an electrostatic latent image corresponding to an image in yellow (Y). A developing bias is applied to the developing roller 41 of the yellow process cartridge 4Y. Then, the toner in yellow (Y) is attached to the electrostatic latent image, such that a toner image in yellow (Y) is developed on the photosensitive drum 1. The toner image in yellow (Y) is transferred to the intermediate transfer belt 5 by the intermediate transfer bias voltage applied to the intermediate transfer roller 6. Once the transfer of the toner image in yellow (Y) corresponding to one page is completed, the exposurer 3 irradiates light corresponding to image information of, for example, magenta (M) to the photosensitive drum 1 recharged to a uniform potential by the charging roller 2 to form an electrostatic latent image corresponding to magenta (M). The magenta process cartridge 4M supplies the toner in magenta M to the electrostatic latent image for development. The toner image in magenta (M) formed on the photosensitive drum 1 is transferred to the intermediate transfer belt 5 so as to overlap the toner image in yellow (Y) that has already been transferred. If the foregoing process is performed with respect to cyan (C) and black (K), a color toner image is formed on the intermediate transfer belt 5 where toner images in yellow (Y), magenta (M), cyan (C), and black (B) overlap. The paper P stacked on a feeding unit 9 is picked up one by one by a pickup roller 91 and is conveyed by a feed roller 92 to a transfer region where the intermediate transfer belt 5 and the transfer roller 7 face each other. The color toner image is transferred by the transfer bias voltage to the paper P passing between the intermediate transfer belt 5 and the transfer roller 7. The fixer 8 applies heat and pressure to the color toner image to fix the color toner image onto the paper P. The paper P passing through the fixer 8 is discharged outside a main body 100 by a discharge roller 93.

The process cartridge 4 is attachable to or detachable from the main body 100. For example, as shown in FIG. 1, a door 110 may be provided on the main body 100. After the door 110 is opened, the process cartridge 4 may be attached to the main body 100 or detached from the main body 100.

Figure 2:
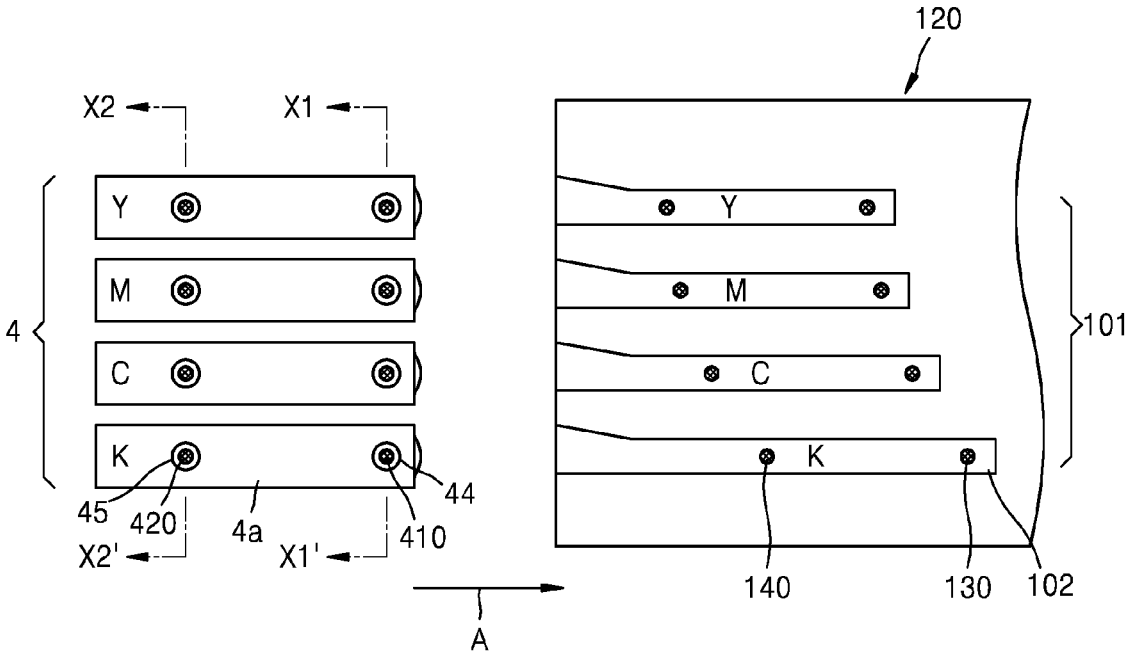
FIG. 2 is a schematic diagram of an example of a structure for attaching and detaching a process cartridge to and from a body.

FIG. 2 is a schematic diagram of an example of a structure for attaching and detaching the process cartridge 4 to and from the main body 100. Referring to FIG. 2, four guide slots 101 for guiding four process cartridges 4 are provided on the main body 100. A first guide protrusion 44 and a second guide protrusion 45 guided along the guide slot 101 are provided on each of the four process cartridges 4. The first guide protrusion 44 and the second guide protrusion 45 are provided on opposite sidewalls 4*a* of the process cartridges 4. For example, the first guide protrusion 44 and the second guide protrusion 45 may protrude from the opposite sidewalls 4*a* of the process cartridge 4. The four guide slots 101 may be provided, for example, in a frame 120 inside the main body 100, and although only one frame 120 is shown in FIG. 2, a pair of frames 120 corresponding to the opposite sidewalls 4*a* of the process cartridge 4 may be provided inside the main body 100.

The opposite sidewalls 4*a* are located on sides orthogonal to a mounting direction A of the process cartridge 4. The sidewalls 4*a* are located on sides in an axial direction of rollers included in the process cartridge 4, e.g., the developing roller 41, the supply roller 42, and so forth, or in an axial direction of rollers included in the main body 100, e.g., the photosensitive drum 1, the charging roller 2, and so forth. The first guide protrusion 44 and the second guide protrusion 45 are spaced apart from each other in the mounting direction A. The first guide protrusion 44 is positioned on a front end portion in the mounting direction A, and the second guide protrusion 45 is positioned on a rear end portion in the mounting direction A. For example, the first guide protrusion 44 may be coaxial with respect to the developing roller 41.

The process cartridge 4 is inserted into the main body 100 until the first guide protrusion 44 arrives at an inner end portion 102 of the guide slot 101. Then, the first guide protrusion 44 and the second guide protrusion 45 are supported by the guide slot 101, and the developing roller 41 is positioned to maintain a developing gap with the photosensitive drum 1. Although not shown in the drawings, a driving portion provided in the main body 100 is connected with a driven portion provided in the process cartridge 4, such that a driving force of the main body 100 is delivered to the developing roller 41, the supply roller 42, and the stirrer 43 through the driving portion and the driven portion.

As described above, a developing bias voltage and a supply bias voltage are applied to the developing roller 41 and the supply roller 42, respectively. A bias voltage may also be applied to the restriction member that is not shown. The process cartridge 4 is electrically connected with the main body 100 when mounted on the main body 100. To this end, the process cartridge 4 is provided with a plurality of cartridge electric contacts. A plurality of set electric contacts electrically connected with the plurality of cartridge electric contacts when the process cartridge 4 is mounted on the main body 100 are provided on the main body 100. The plurality of cartridge electric contacts are electrically connected to the developing roller 41, the supply roller 42, and the restriction member. The plurality of set electric contacts are electrically connected to a power supply unit provided on the main body 100.

For stable electric connection, the plurality of cartridge electric contacts and the plurality of set electric contacts are biased in a direction to contact each other. For example, one of a cartridge electric contact and a set electric contact that correspond to each other is a movable electric contact that is movable in a direction to contact the other, that is, an axial direction, and the other is a fixed electric contact that has a fixed position. For example, the movable electric contact may be biased in a direction to contact the fixed electric contact by means of an elastic force.

Referring to FIG. 2, the cartridge electric contact may include a first cartridge electric contact 410 and a second cartridge electric contact 420. The first cartridge electric contact 410 is positioned on a front end portion along the mounting direction A of the process cartridge 4, and the second cartridge electric contact 420 is positioned on a rear end portion along the mounting direction A of the process cartridge 4. For example, the first cartridge electric contact 410 may be positioned on the first guide protrusion 44, and the second cartridge electric contact 420 may be positioned on the second guide protrusion 45. The set electric contacts may include a first set electric contact 130 and a second set electric contact 140 corresponding to the first cartridge electric contact 410 and the second cartridge electric contact 420, respectively. For example, the first set electric contact 130 and the second set electric contact 140 may be provided on the guide slot 101.

One of the first cartridge electric contact 410 and the second cartridge electric contact 420 is a movable electric contact, and the other is a fixed electric contact, and their corresponding first and second set electric contacts 130 and 140 are a fixed electric contact and a movable electric contact, respectively. That is, the cartridge electric contact and the set electric contact are paired as the movable electric contact and the fixed electric contact or as the fixed electric contact and the movable electric contact.

Figure 3:
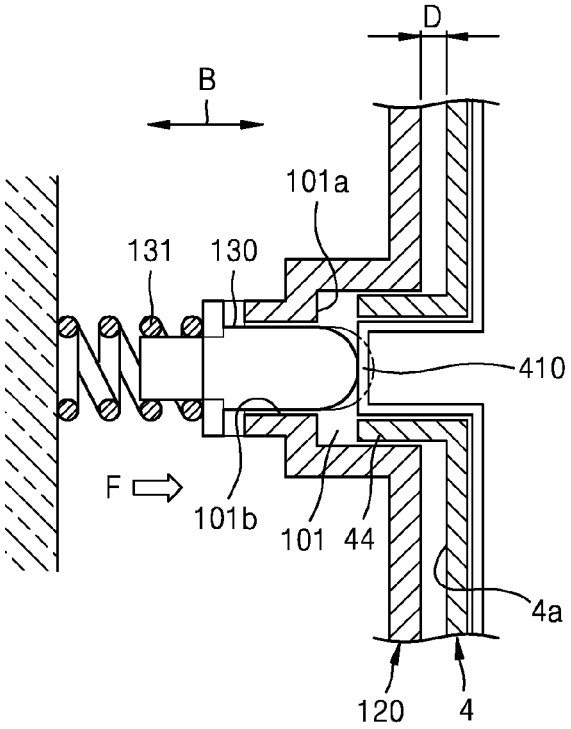
FIG. 3 is a cross-sectional view taken along a line X1-X1' of FIG. 2.

In the current embodiment, the first cartridge electric contact 410 is a fixed electric contact, the first set electric contact 130 corresponding to the first cartridge electric contact 410 is a movable electric contact, the second cartridge electric contact 420 is a movable electric contact, and the second set electric contact 140 corresponding to the second cartridge electric contact 420 is a fixed electric contact. FIG. 3 is a cross-sectional view taken along a line X1-X1' of FIG. 2, and FIG. 4 is a cross-sectional view taken along a line X2-X2' of FIG. 2.

Referring to FIG. 3, the first guide protrusion 44 has a cylindrical shape protruding from, for example, the sidewall 4*a* of the process cartridge 4. The first cartridge electric contact 410 is provided in a center portion of the first guide protrusion 44. The first cartridge electric contact 410 may be formed of, for example, an electric conductor, and is coupled to the first guide protrusion 44 in a way to be fixed along an axial direction B that is orthogonal to the mounting direction A. The axial direction B is the axial direction of rollers included in the process cartridge 4, e.g., the developing roller 41, the supply roller 42, and so forth, or an axial direction of rollers included in the main body 100, e.g., the photosensitive drum 1, the charging roller 2, and so forth. The first set electric contact 130 is installed in a guide hole 101*b* provided in an inner wall 101*a* of the guide slot 101 in such a way to move along the axial direction B. An elastic member 131 applies an elastic force F such that the first set electric contact 130 protrudes in a direction to contact the first cartridge electric contact 410.

Figure 4:
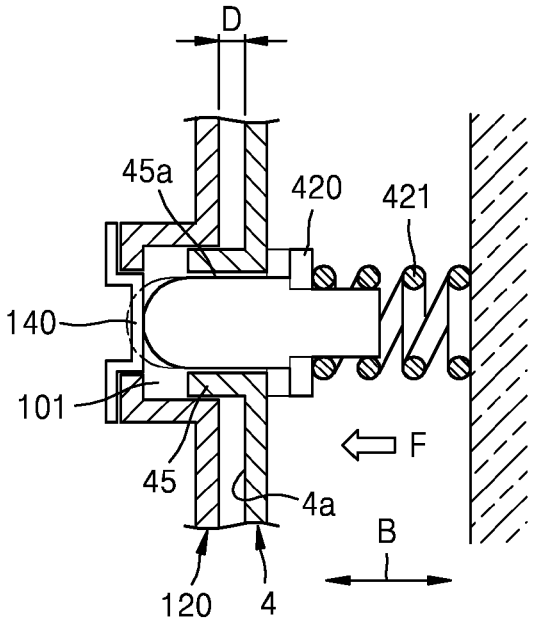
FIG. 4 is a cross-sectional view taken along a line X2-X2' of FIG. 2.

Referring to FIG. 4, the second guide protrusion 45 has a cylindrical shape protruding from, for example, the sidewall 4*a* of the process cartridge 4. The second cartridge electric contact 420 is installed in a guide hole 45*a* provided in the second guide protrusion 45 in such a way to move along the axial direction B, that is, in a direction protruding from the sidewall 4*a*. An elastic member 421 applies the elastic force F such that the second cartridge electric contact 420 protrudes in a direction to contact the second set electric contact 140. That is, the elastic member 421 elastically biases the second cartridge electric contact 420 such that the second cartridge electric contact 420 protrudes from the sidewall 4*a*. The second set electric contact 140 may be formed of, for example, an electric conductor, and is coupled to the inner wall 101*a* of the guide slot 101 in a way to be fixed along the axial direction B that is orthogonal to the mounting direction A.

A process of mounting the process cartridge 4 on the main body 100 will be described.

Before the process cartridge 4 is mounted on the main body 100, as indicated by a dotted line in FIG. 3, the first set electric contact 130 has protruded from the inner wall 101*a* of the guide slot 101 by means of the elastic force of the elastic member 131. As indicated by a dotted line in FIG. 4, the second cartridge electric contact 420 has protruded from the second guide protrusion 45 by means of the elastic force of the elastic member 421. In this state, the process cartridge 4 is mounted on the main body 100.

First, the first guide protrusion 44 is inserted into the guide slot 101 and moves to the inner end portion 102 along the guide slot 101. The first guide protrusion 44 moves to a position where the first set electric contact 130 is installed, after passing through a position where the second set electric contact 140 is installed. Both the first cartridge electric contact 410 and the second set electric contact 140 are fixed electric contacts. Thus, when the first guide protrusion 44 passes through the second set electric contact 140, the first cartridge electric contact 410 and the first set electric contact 140 do not contact each other. The first cartridge electric contact 410 does not contact the inner wall 101*a* of the guide slot 101, either. Thus, in an initial mounting process, the process cartridge 4 may smoothly move in the mounting direction A along the guide slot 101.

As the process cartridge 4 continues moving along the mounting direction A, the second guide protrusion 45 is inserted into the guide slot 101.

When the mounting of the process cartridge 4 is almost completed, the first cartridge electric contact 410 and the second cartridge electric contact 420 contact the first set electric contact 130 and the second set electric contact 140, respectively. As the first set electric contact 130, which is a movable electric contact, contacts the first cartridge electric contact 410, the first set electric contact 130 is slightly pushed in a reverse direction with respect to the elastic force of the elastic member 131. The elastic member 131 is elastically transformed as much as a pushed amount of the first set electric contact 130, and the elastic member 131 applies the elastic force F that is proportional to the pushed amount to the first set electric contact 130, such that the first set electric contact 130 continues contacting the first cartridge electric contact 410. As the second cartridge electric contact 420, which is a movable electric contact, contacts the second cartridge electric contact 140, the second set electric contact 420 is slightly pushed in a reverse direction with respect to the elastic force of the elastic member 421. The elastic member 421 is elastically transformed as much as a pushed amount of the second cartridge electric contact 420, and the elastic member 421 applies the elastic force F that is proportional to the pushed amount to the second cartridge electric contact 420, such that the second cartridge electric contact 420 continues contacting the second set electric contact 140.

Figure 5:
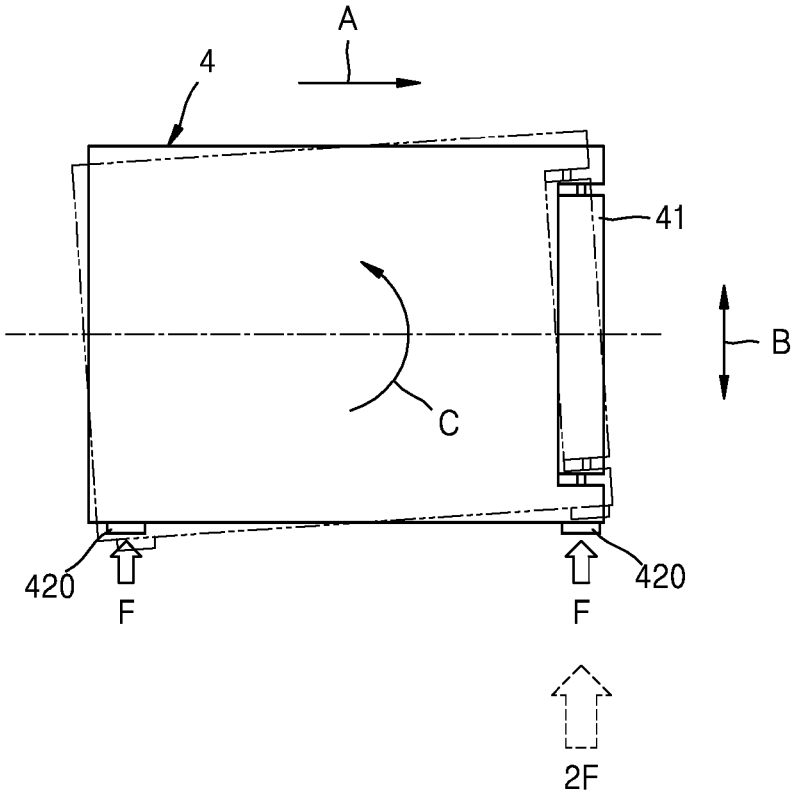
FIG. 5 shows a mounted state of a process cartridge with respect to a position of a cartridge electric contact.

There is a gap (D in FIGS. 3 and 4) between the pair of frames 120 supporting the process cartridge 4 and the process cartridge 4. FIG. 5 shows a mounted state of the process cartridge 4 with respect to a position of a cartridge electric contact. When both the first cartridge electric contact 410 and the second cartridge electric contact 420 are positioned on a front end portion of the process cartridge 4, the elastic forces of the elastic members 131 and 421 works on the front end portion of the process cartridge 4, such that a force of 2F (a dotted line of FIG. 5) works on the front end portion of the process cartridge 4. Then, the front end portion of the process cartridge 4 is pushed in a direction of the elastic force, such that the process cartridge 4 rotates in an arrow direction C. Then, a developing gap between the developing roller 41 and the photosensitive drum 1 may not be uniform in the axial direction of the developing roller 41. The driven portion provided on the process cartridge 4 may be misaligned with the axial direction B of the driving portion provided in the main body 100, causing unstable power connection. Non-uniformity of the developing gap and unstability of power connection may degrade image quality. Such image quality degradation may occur when both the first and second cartridge electric contacts 410 and 420 are positioned on the rear end portion of the process cartridge 4.

In the current embodiment, the first cartridge electric contact 410 is positioned on the front end portion along the mounting direction A of the process cartridge 4, and the second cartridge electric contact 420 is positioned on the rear end portion along the mounting direction A of the process cartridge 4. The cartridge electric contact and the set electric contact are paired as the movable electric contact and the fixed electric contact or as the fixed electric contact and the movable electric contact. With this structure, a force of F (a solid line of FIG. 5) works on each of the front end portion and the rear end portion of the process cartridge 4, the process cartridge 4 is pushed along the axial direction B without rotating. Thus, the developing gap between the developing roller 41 and the photosensitive drum 1 may be maintained constant along the axial direction of the developing roller 41, and the driven portion provided on the process cartridge 4 and the driving portion provided on the main body 100 may be maintained aligned along the axial direction B. Hence, the developing gap may be maintained uniform, and the driving connection may also be maintained stable.

According to the current embodiment, the first cartridge electric contact 410 positioned on the front end portion along the mounting direction A is a fixed electric contact, and the second cartridge electric contact 420 positioned on the rear end portion along the mounting direction A is a movable electric contact. Thus, when the process cartridge 4 is attached to or detached from the main body 100, interference between the first and second cartridge electric contacts 410 and 420 and the guide slot 101 may be minimized. Moreover, the first set electric contact 130 and the second set electric contact 140 corresponding to the first cartridge electric contact 410 and the second cartridge electric contact 420, respectively, are a movable electric contact and a fixed electric contact, respectively. Thus, when the process cartridge 4 is attached to or detached from the main body 100, interference between the first and second set electric contacts 130 and 140 and the process cartridge 4 may be minimized.

When the first and second cartridge electric contacts 410 and 420 are formed separately from the first guide protrusion 44 and the second guide protrusion 45, the first and second set electric contacts 130 and 140 interfere with the first and second guide protrusions 44 and 45 and the first and second cartridge electric contacts 410 and 420 during attachment or detachment of the process cartridge 4 to or from the main body 100. According to the current embodiment, the first cartridge electric contact 410 and the second cartridge electric contact 420 are provided on the first guide protrusion 44 and the second guide protrusion 45, respectively. Thus, during attachment and detachment of the process cartridge 4 to and from the main body 100, interfering sites between the main body 100 and the process cartridges 4 may be reduced, thereby stably and gently attaching or detaching the process cartridge 4 to or from the main body 100.

The shapes of the first set electric contact 130 and the second cartridge electric contact 420 which are movable electric contacts are not limited to the shapes shown in FIGS. 3 and 4. For example, although compression coil springs are used as the elastic members 131 and 421 that apply the elastic force to the first set electric contact 130 and the second cartridge electric contact 420 in FIGS. 3 and 4, torsion springs or leaf springs may also be used.

Figure 6:
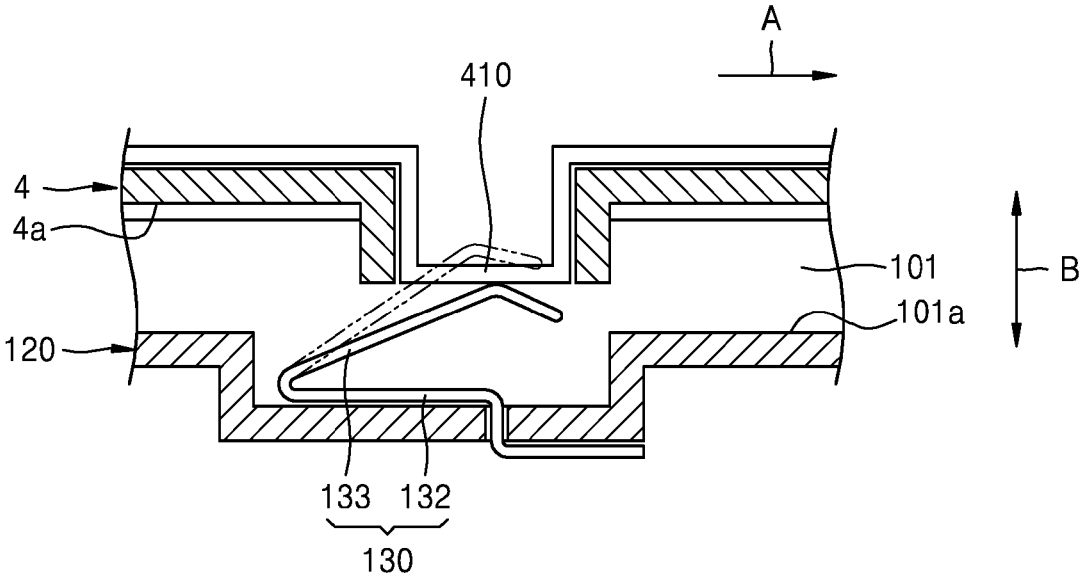
FIG. 6 is a schematic cross-sectional view of a first set electric contact which is a movable electric contact according to an embodiment.
Figure 7:
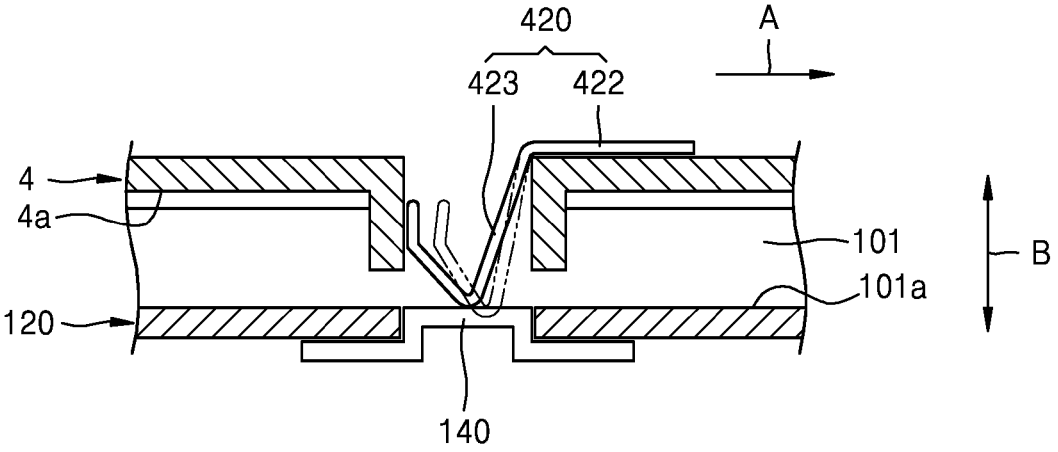
FIG. 7 is a schematic cross-sectional view of a second cartridge electric contact which is a movable electric contact according to an embodiment.

The first set electric contact 130 and the second cartridge electric contact 420, which are movable electric contacts, may have elasticity. FIGS. 6 and 7 are cross-sectional views of the first set electric contact 130 and the second cartridge electric contact 420, which are movable electric contacts, according to an embodiment.

Referring to FIG. 6, the first guide protrusion 44 has a cylindrical shape protruding from, for example, the sidewall 4*a* of the process cartridge 4. The first cartridge electric contact 410 is provided in a center portion of the first guide protrusion 44. The first cartridge electric contact 410 may be formed of, for example, an electric conductor, and is coupled to the first guide protrusion 44 in a way to be fixed along an axial direction B that is orthogonal to the mounting direction A. The first set electric contact 130 may include a support portion 132 supported on the inner wall 101*a* of the guide slot 101 and an elastic portion 133 that extends from the support portion 132 and elastically contacts the first cartridge electric contact 410. The first set electric contact 130 shaped as described above may be manufactured, for example, with a leaf spring that is an electric conductor. The elastic portion 133 is elastically bendable with respect to the support portion 132. Thus, the movable first set electric contact 130 in which the elastic portion 133 elastically moves along the axial direction B may be implemented.

Referring to FIG. 7, the second guide protrusion 45 has a cylindrical shape protruding from, for example, the sidewall 4*a* of the process cartridge 4. The second cartridge electric contact 420 may include a support portion 422 supported on the sidewall 4*a* of the process cartridge 4 and an elastic portion 423 that extends from the support portion 422 and elastically contacts the second set electric contact 140. The second cartridge electric contact 420 shaped as described above may be manufactured, for example, with a leaf spring that is an electric conductor. The elastic portion 423 is elastically bendable with respect to the support portion 422. Thus, the movable second cartridge electric contact 420 in which the elastic portion 423 elastically moves along the axial direction B may be implemented. The second set electric contact 140 may be formed of, for example, an electric conductor, and is coupled to the inner wall 101*a* of the guide slot 101 in a way to be fixed along the axial direction B that is orthogonal to the mounting direction A.

Figure 8:
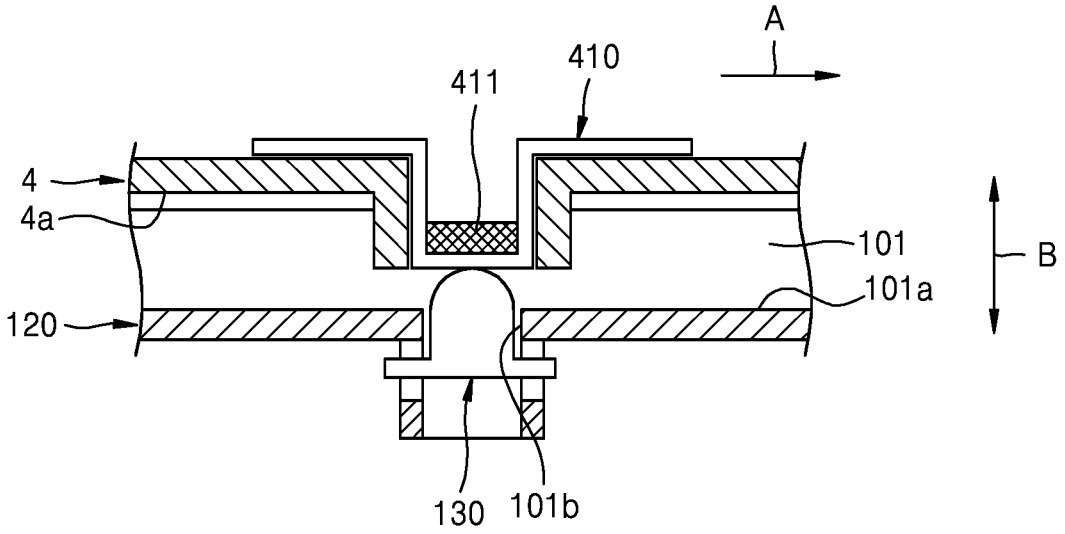
FIG. 8 is a schematic cross-sectional view of a first set electric contact which is a movable electric contact according to an embodiment.
Figure 9:
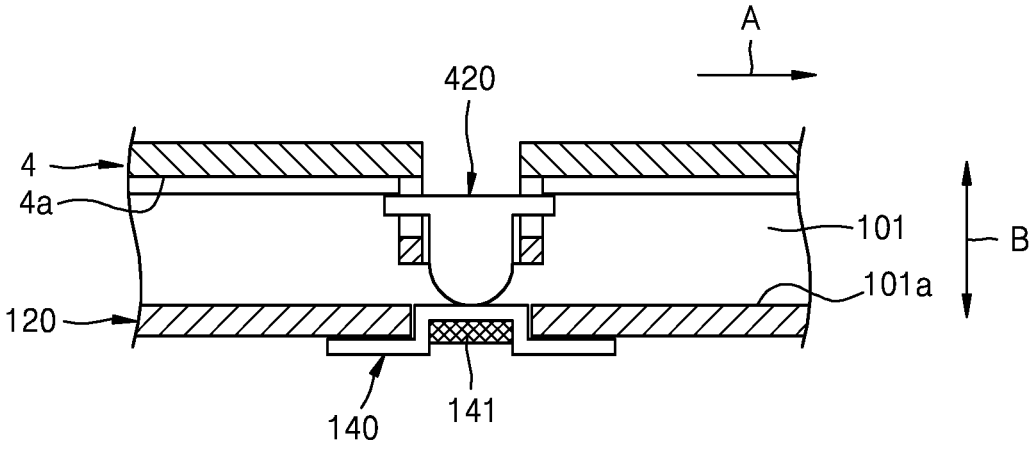
FIG. 9 is a schematic cross-sectional view of a second cartridge electric contact which is a movable electric contact according to an embodiment.

The first set electric contact 130 and the second cartridge electric contact 420, which are movable electric contacts, may move along the axial direction B by means of a magnetic force. FIGS. 8 and 9 are cross-sectional views of the first set electric contact 130 and the second cartridge electric contact 420, which are movable electric contacts, according to an embodiment.

Referring to FIG. 8, the first guide protrusion 44 has a cylindrical shape protruding from, for example, the sidewall 4*a* of the process cartridge 4. The first cartridge electric contact 410 is provided in a center portion of the first guide protrusion 44. The first cartridge electric contact 410 may be formed of, for example, an electric conductor, and is coupled to the first guide protrusion 44 in a way to be fixed along an axial direction B that is orthogonal to the mounting direction A. A magnet 411 is positioned in adjacent to the first cartridge electric contact 410. The first set electric contact 130 is installed in a guide hole 101*b* provided in an inner wall 101*a* of the guide slot 101 in such a way to move along the axial direction B. The first set electric contact 130 may include a magnetic body drawn by a magnetic force. With this structure, when the process cartridge 4 is mounted on the main body 100, if the first cartridge electric contact 410 and the first set electric contact 130 approach each other, the first set electric contact 130 moves toward the first cartridge electric contact 410 by means of the magnetic force of the magnet 411, thus contacting the first cartridge electric contact 410. The first set electric contact 130 may be a magnet, and the first cartridge electric contact 410 may include a magnetic body that sticks the magnet. The magnet 411 is positioned in adjacent to the first set electric contact 130 in the main body 100, and the first cartridge electric contact 410 may include a magnetic body. Thus, at least one of the first set electric contact 130 and the first cartridge electric contact 410 may be a magnet or the magnet 411 may be positioned in adjacent to the at least one of the first set electric contact 130 and the first cartridge electric contact 410, such that the first set electric contact 130 may contact the first cartridge electric contact 410 by means of the magnetic force.

Referring to FIG. 9, the second set electric contact 140 may be formed of, for example, an electric conductor, and is coupled to the inner wall 101*a* of the guide slot 101 in a way to be fixed along the axial direction B that is orthogonal to the mounting direction A. A magnet 141 is positioned in adjacent to the second set electric contact 140. The second guide protrusion 45 has a cylindrical shape protruding from, for example, the sidewall 4*a* of the process cartridge 4. The second cartridge electric contact 420 is installed in the second guide protrusion 45 in such a way to move along the axial direction B. The second cartridge electric contact 420 may include a magnetic body drawn by a magnetic force. With this structure, when the process cartridge 4 is mounted on the main body 100, if the second cartridge electric contact 420 and the second set electric contact 140 approach each other, the second cartridge electric contact 420 moves toward the second set electric contact 140 by means of the magnetic force of the magnet 141, thus contacting the second set electric contact 140. The second cartridge electric contact 420 may be a magnet, and the second set electric contact 140 may include a magnetic body that sticks the magnet. The magnet 141 is installed to move together with the second cartridge electric contact 420 in the process cartridge 4 along the axial direction B, and the second set electric contact 140 may include a magnetic body. Thus, at least one of the second cartridge electric contact 420 and the second set electric contact 140 may be a magnet or the magnet 141 may be positioned in adjacent to the at least one of the second cartridge electric contact 420 and the second set electric contact 140, such that the second cartridge electric contact 420 may contact the second set electric contact 140 by means of the magnetic force.

Figure 10:
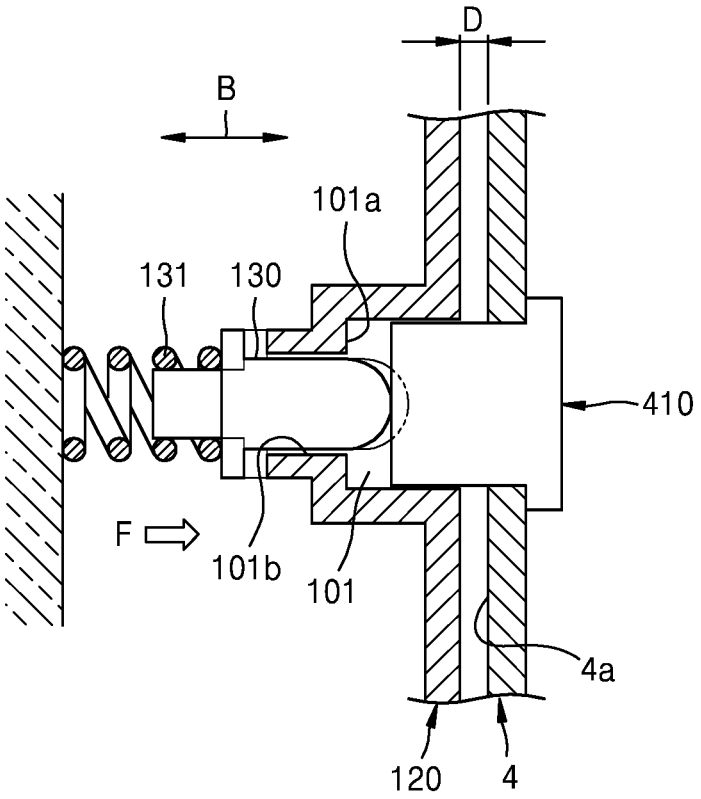
FIG. 10 is a schematic cross-sectional view of a first cartridge electric contact according to an embodiment.

The first cartridge electric contact 410, which is a fixed electric contact, may function as the first guide protrusion 44. FIG. 10 is a schematic cross-sectional view of the first cartridge electric contact 410 according to an embodiment. Referring to FIG. 10, the first cartridge electric contact 410 is fixed onto the sidewall 4*a* of the process cartridge 4. The first cartridge electric contact 410 protrudes from the sidewall 4*a* and is inserted into the guide slot 101. With the foregoing structure described above, the structure of the process cartridge 4 may be simplified.

Although the first cartridge electric contact 410 and the second cartridge electric contact 420 have been described as being provided in the process cartridge 4 in the foregoing embodiments, an additional electric contact may be further provided in the process cartridge 4 if necessary. In this case, the at least first cartridge electric contact 410 and the second cartridge electric contact 420 are provided on the front end portion and the rear end portion of the process cartridge 4, respectively. The first cartridge electric contact 410 and the second cartridge electric contact 420 may be provided on the first guide protrusion 44 and the second guide protrusion 45, respectively.

The cartridge electric contact and the set electric contact applied to the process cartridge 4 including the developing roller 41 have been described in the foregoing embodiment, but the cartridge electric contact and the set electric contact in the foregoing embodiment may also be applied to process cartridges in other forms.

Figure 11:
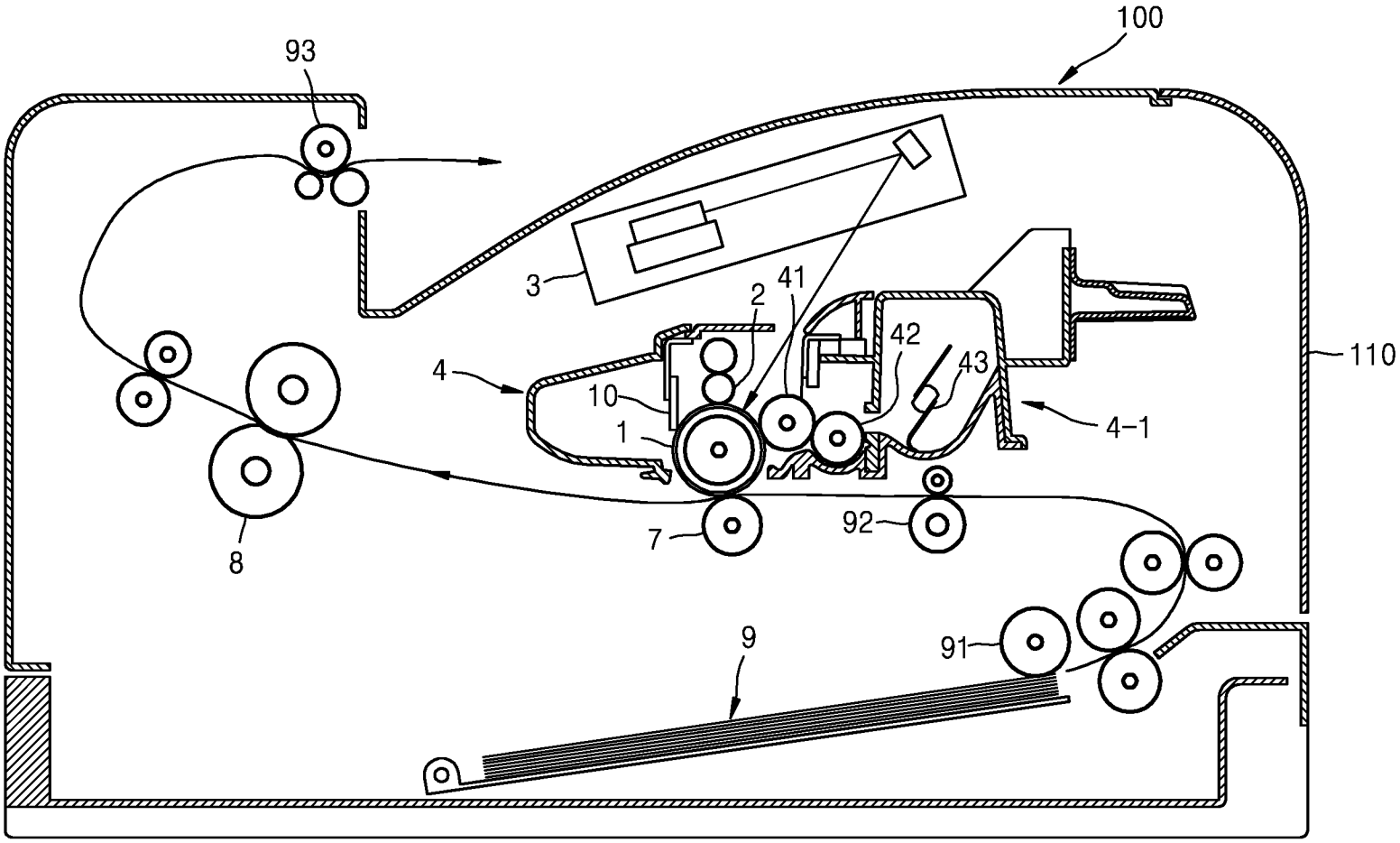
FIG. 11 is a schematic diagram of an electro-photographic image forming apparatus according to an embodiment.

FIG. 11 is a schematic diagram of an electro-photographic image forming apparatus according to an embodiment. An electro-photographic image forming apparatus according to the current embodiment is a monochromatic image forming apparatus including the integral-type process cartridge 4. In FIG. 11, an element having the same function as an element of the image forming apparatus shown in FIG. 1 is indicated by the same reference numeral and a repetitive description will be omitted.

The process cartridge 4 is an integral-type process cartridge including the photosensitive drum 1 and the developing roller 41. The transfer roller 7 is positioned to face the photosensitive drum 1, and the paper P is conveyed between the photosensitive drum 1 and the transfer roller 7.

With this structure, the exposurer 3 irradiates light modulated corresponding to image information to the photosensitive drum 1 to form an electrostatic latent image. The developing roller 41 supplies a toner to the electrostatic latent image to form a visible toner image on the surface of the photosensitive drum 1. The paper P stacked on the feeding unit 9 is conveyed by the pickup roller 91 and the feed roller 92 to the region where the photosensitive drum 1 and the transfer roller 7 face each other, and the toner image is transferred to the paper P from the photosensitive drum 1 by a transfer bias voltage applied to the transfer roller 7. Once the paper P passes through the fixer 8, the toner image is fixed onto the paper P by heat and pressure. The paper P which has been fixed is discharged by the discharge roller 93.

Figure 12:
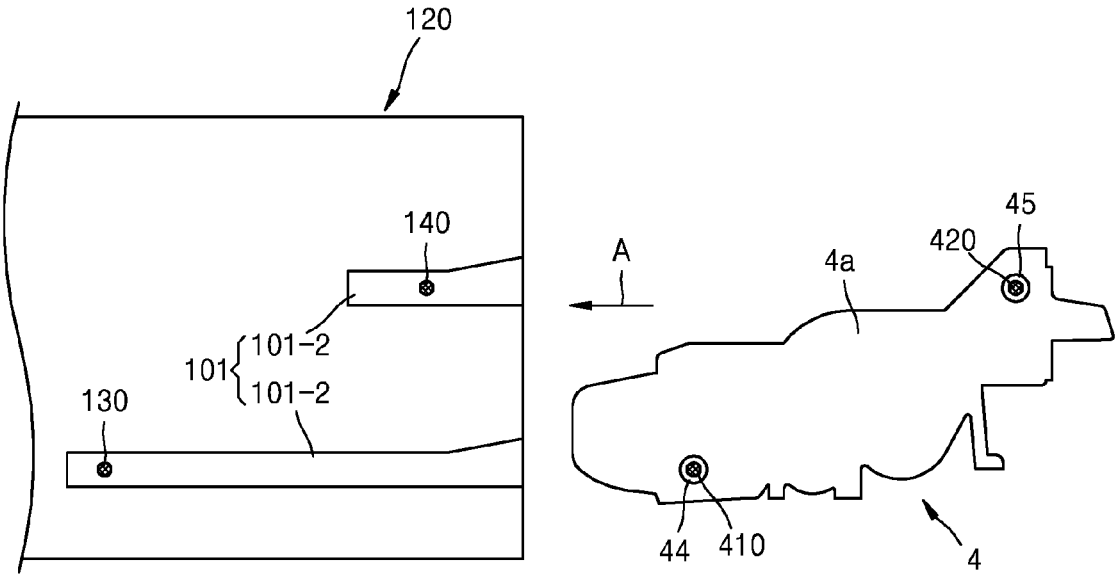
FIG. 12 is a schematic diagram of an example of a structure for attaching and detaching a process cartridge to and from a body.

FIG. 12 is a schematic diagram of an example of a structure for attaching and detaching the process cartridge 4 on and from the main body 100. Referring to FIG. 12, in the process cartridge 4, along the mounting direction A, the first guide protrusion 44 is provided on the front end portion and the second guide protrusion 45 is provided on the rear end portion. The first guide protrusion 44 and the second guide protrusion 45 are provided on opposite sidewalls 4*a* of the process cartridges 4. For example, the first guide protrusion 44 and the second guide protrusion 45 may protrude from the opposite sidewalls 4*a* of the process cartridge 4. For example, the first guide protrusion 44 may be coaxial with the photosensitive drum 1.

On the main body 100 is provided the guide slot 101 into which the first guide protrusion 44 and the second guide protrusion 45 are inserted to be guided. The guide slot 101 according to the current embodiment may include the first guide slot 101-1 and the second guide slot 101-2 into which the first guide protrusion 44 and the second guide protrusion 45 are inserted, respectively. The first guide slot 101-1 and the second guide slot 101-2 may be provided, for example, in the frame 120 inside the main body 100, and although only one frame 120 is shown in FIG. 12, the pair of frames 120 corresponding to the opposite sidewalls 4*a* of the process cartridge 1 may be provided inside the main body 100.

A developing bias voltage and a supply bias voltage are applied to the developing roller 41 and the supply roller 42. The bias voltage may also be applied to the restriction member that is not shown. The photosensitive drum 1 may be grounded. The charging bias voltage may also be applied to the charging roller 2. The process cartridge 4 is electrically connected with the main body 100 when mounted on the main body 100. To this end, the process cartridge 4 is provided with a plurality of cartridge electric contacts. A plurality of set electric contacts electrically connected with the plurality of cartridge electric contacts when the process cartridge 4 is mounted on the main body 100 are provided on the main body 100. The plurality of cartridge electric contacts are electrically connected to the photosensitive drum 1, the charging roller 2, the developing roller 41, the supply roller 42, and the restriction member. The plurality of set electric contacts are electrically connected to a power supply unit provided on the main body 100.

Referring to FIG. 12, the cartridge electric contact may include a first cartridge electric contact 410 and a second cartridge electric contact 420. The first cartridge electric contact 410 is positioned on a front end portion along the mounting direction A of the process cartridge 4, and the second cartridge electric contact 420 is positioned on a rear end portion along the mounting direction A of the process cartridge 4. For example, the first cartridge electric contact 410 may be positioned on the first guide protrusion 44, and the second cartridge electric contact 420 may be positioned on the second guide protrusion 45. The set electric contacts may include a first set electric contact 130 and a second set electric contact 140 corresponding to the first cartridge electric contact 410 and the second cartridge electric contact 420, respectively. For example, the first set electric contact 130 and the second set electric contact 140 may be provided on the first guide slot 101-1 and the second guide slot 101-2, respectively.

One of the first cartridge electric contact 410 and the second cartridge electric contact 420 is a movable electric contact, and the other is a fixed electric contact, and their corresponding first and second set electric contacts 130 and 140 are a fixed electric contact and a movable electric contact, respectively. That is, the cartridge electric contact and the set electric contact are paired as the movable electric contact and the fixed electric contact or as the fixed electric contact and the movable electric contact. For example, the first cartridge electric contact 410 is a fixed electric contact, the first set electric contact 130 corresponding to the first cartridge electric contact 410 is a movable electric contact, the second cartridge electric contact 420 is a movable electric contact, and the second set electric contact 140 corresponding to the second cartridge electric contact 420 is a fixed electric contact. The structures of the first cartridge electric contact 410 and the second cartridge electric contact 420 and the structures of the first set electric contact 130 and the second set electric contact 140 may have the structures shown in FIGS. 3, 4, 6, 7, 8, 9, and 10.

Figure 13:
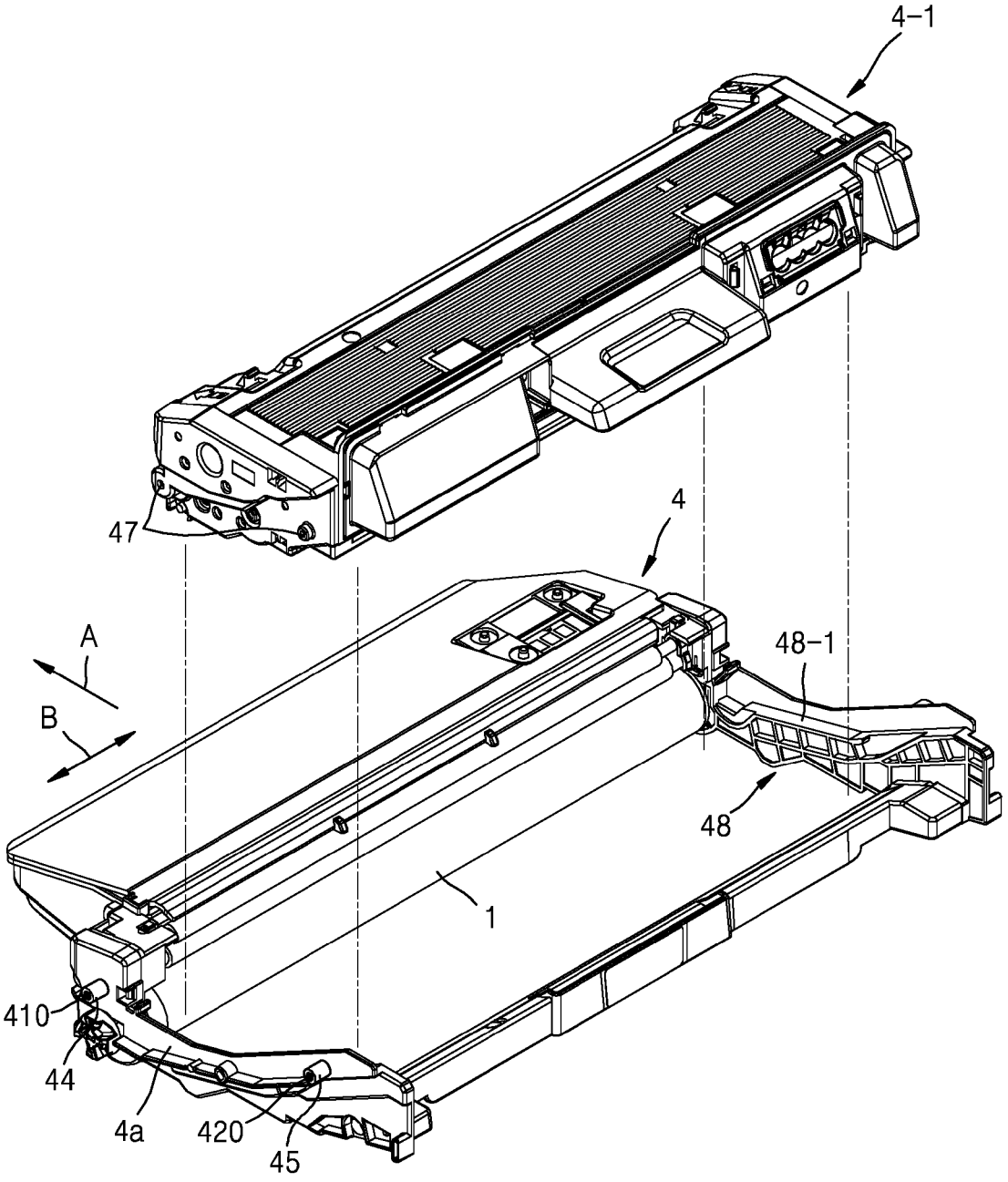
FIG. 13 is an exploded perspective view of a process cartridge according to an embodiment.

The process cartridge 4 shown in FIG. 11 may include a developing cartridge 4-1 including the developing roller 41. The developing cartridge 4-1 may be replaced separately. FIG. 13 is an exploded perspective view of the process cartridge 4 according to an embodiment. Referring to FIGS. 11 and 13, the process cartridge 4 may include the photosensitive drum 1. The process cartridge 4 may further include the charging roller 2 for charging the photosensitive drum 1. The process cartridge 4 may further include a cleaning means 10 for removing a waste toner from the photosensitive drum 1. The developing cartridge 4-1 is attachable to or detachable from the process cartridge 4. A toner is received in the developing cartridge 4-1 and the toner is delivered to the photosensitive drum 1 through the stirrer 43, the supply roller 42, and the developing roller 41. The process cartridge 4 is provided with a mounting portion 48 on which the developing cartridge 4-1 is mounted. The mounting portion 48 may include a guide rail 48-1. The developing cartridge 4-1 may be provided with a guide protrusion 47 guided along the guide rail 48-1.

When the developing cartridge 4-1 is mounted on the process cartridge 4, the process cartridge 4 may be attached to or detached from the main body 100. When the process cartridge 4 is mounted on the main body 100, the developing cartridge 4-1 may be attached to or detached from the mounting portion 48.

With this structure, the process cartridge 4 and the developing cartridge 4-1 may be separately attached to or detached from the main body 100, simplifying replacement of the process cartridge 4 or the developing cartridge 4-1. During attachment or detachment, the process cartridge 4 and the developing cartridge 4-1 are separately handled to alleviate the burden of weight to a user, thereby improving user convenience.

Referring to FIG. 13, in the process cartridge 4, along the mounting direction A, the first guide protrusion 44 is provided on the front end portion and the second guide protrusion 45 is provided on the rear end portion. The first guide protrusion 44 and the second guide protrusion 45 are provided on opposite sidewalls 4*a* of the process cartridges 4. For example, the first guide protrusion 44 and the second guide protrusion 45 may protrude from the opposite sidewalls 4*a* of the process cartridge 4.

Referring to FIG. 12, the guide slot 101 into which the first guide protrusion 44 and the second guide protrusion 45 are inserted to be guided are provided on the main body 100. The guide slot 101 according to the current embodiment may include the first guide slot 101-1 and the second guide slot 101-2 into which the first guide protrusion 44 and the second guide protrusion 45 are inserted, respectively. The first guide slot 101-1 and the second guide slot 101-2 may be provided, for example, in the frame 120 inside the main body 100, and although only one frame 120 is shown in FIG. 12, the pair of frames 120 corresponding to the opposite sidewalls 4*a* of the process cartridge 1 may be provided inside the main body 100.

The process cartridge 4 is provided with a plurality of cartridge electric contacts. A plurality of set electric contacts electrically connected with the plurality of cartridge electric contacts when the process cartridge 4 is mounted on the main body 100 are provided on the main body 100.

Referring to FIG. 13, the cartridge electric contact may include the first cartridge electric contact 410 and the second cartridge electric contact 420. The first cartridge electric contact 410 is positioned on a front end portion along the mounting direction A of the process cartridge 4, and the second cartridge electric contact 420 is positioned on a rear end portion along the mounting direction A of the process cartridge 4. For example, the first cartridge electric contact 410 may be positioned on the first guide protrusion 44, and the second cartridge electric contact 420 may be positioned on the second guide protrusion 45.

Referring to FIG. 12, the set electric contacts may include the first set electric contact 130 and the second set electric contact 140 corresponding to the first cartridge electric contact 410 and the second cartridge electric contact 420, respectively. For example, the first set electric contact 130 and the second set electric contact 140 may be provided on the first guide slot 101-1 and the second guide slot 101-2, respectively.

One of the first cartridge electric contact 410 and the second cartridge electric contact 420 is a movable electric contact, and the other is a fixed electric contact, and their corresponding first and second set electric contacts 130 and 140 are a fixed electric contact and a movable electric contact, respectively. That is, the cartridge electric contact and the set electric contact are paired as the movable electric contact and the fixed electric contact or as the fixed electric contact and the movable electric contact. For example, the first cartridge electric contact 410 is a fixed electric contact, the first set electric contact 130 corresponding to the first cartridge electric contact 410 is a movable electric contact, the second cartridge electric contact 420 is a movable electric contact, and the second set electric contact 140 corresponding to the second cartridge electric contact 420 is a fixed electric contact. The structures of the first cartridge electric contact 410 and the second cartridge electric contact 420 and the structures of the first set electric contact 130 and the second set electric contact 140 may have the structures shown in FIGS. 3, 4, 6, 7, 8, 9, and 10.

According to the above-described embodiments, a process cartridge having an electric connection structure capable of maintaining position stability of the process cartridge and an electro-photographic image forming apparatus using the process cartridge may be implemented.

According to the above-described embodiments, a process cartridge for reducing interference between the process cartridge and electric contacts of a body and an electro-photographic image forming apparatus using the process cartridge may be implemented.

While the light modulation device has been shown and described in connection with the embodiments, it will be apparent to those of ordinary skill in the art that modifications and variations can be made without departing from the spirit and scope of the embodiments as defined by the appended claims. Therefore, the true technical scope of the present disclosure should be defined by the appended claims.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A process cartridge attachable to and detachable from an image forming apparatus, the process cartridge comprising:

a roller;

a sidewall disposed on an axial direction of the roller;

a first cartridge electric contact provided on the sidewall; and a second cartridge electric contact provided on the sidewall, wherein one of the first cartridge electric contact and the second cartridge electric contact is a fixed electric contact, and the other of the first cartridge electric contact and the second cartridge electric contact is a movable electric contact that is movable in a direction in which the other of the first cartridge electric contact and the second cartridge electric contact protrudes from the sidewall.

2. The process cartridge of claim 1, wherein the first cartridge electric contact and the second cartridge electric contact are positioned at a front end portion and a rear end portion of the sidewall, respectively, along a mounting direction of the process cartridge into the image forming apparatus.

3. The process cartridge of claim 2, wherein the first cartridge electric contact is the fixed electric contact and the second cartridge electric contact is the movable electric contact.

4. The process cartridge of claim 3, wherein the first cartridge electric contact is insertable into a guide rail provided on a main body of the image forming apparatus to guide attachment and detachment of the process cartridge to the image forming apparatus.

5. The process cartridge of claim 4, further comprising:

a first guide protrusion and a second guide protrusion on the front end portion and the rear end portion of the sidewall, respectively, so that the process cartridge is insertable into the guide rail, wherein the first cartridge electric contact and the second cartridge electric contact are in the first guide protrusion and the second guide protrusion, respectively.

6. The process cartridge of claim 1, wherein the movable electric contact is elastically biased by an elastic force in the direction in which the movable electric contact protrudes from the sidewall.

7. The process cartridge of claim 1, wherein the movable electric contact protrudes from the sidewall by a magnetic force.

8. The process cartridge of claim 1, wherein the roller comprises a photosensitive drum on which an electrostatic latent image is formed.

9. The process cartridge of claim 8, wherein the roller further comprises a developing roller to supply a toner to the electrostatic latent image.

10. The process cartridge of claim 9, further comprising:

a mounting portion; and a developing cartridge comprising the developing roller, wherein the developing cartridge is attachable to and detachable from the mounting portion.

11. The process cartridge of claim 1, wherein the roller comprises a developing roller to supply a toner from the process cartridge to an electrostatic latent image formed on a photosensitive drum of the image forming apparatus.

12. An electro-photographic image forming apparatus comprising:

a main body comprising a first set electric contact and a second set electric contact; and the process cartridge of claim 1 that is attachable to or detachable from the main body, wherein when the process cartridge is attached to the main body, the first cartridge electric contact and the second cartridge electric contact contact the first set electric contact and the second set electric contact, respectively.

13. The electro-photographic image forming apparatus of claim 12, wherein the first and second set electric contacts and the first and second cartridge electric contacts are paired as the fixed electric contact and the movable electric contact or as the fixed electric contact and the movable electric contact, respectively.

14. A process cartridge attachable to and detachable from an image forming apparatus, the process cartridge comprising:

a roller;

a sidewall disposed on an axial direction of the roller;

a first guide protrusion and a second guide protrusion provided on a front end portion and a rear end portion of the sidewall, respectively, and insertable into a guide rail provided on the image forming apparatus;

a first cartridge electric contact provided in the first guide protrusion; and a second cartridge electric contact provided in the second guide protrusion, wherein the first cartridge electric contact is a fixed electric contact, and the second cartridge electric contact is a movable electric contact that is movable in a direction in which the second cartridge electric contact protrudes from the sidewall.

15. The process cartridge of claim 14, further comprising an elastic member elastically biasing the second cartridge electric contact in the direction in which the second cartridge electric contact protrudes from the sidewall.

16. The process cartridge of claim 14, wherein the second cartridge electric contact comprises a magnetic body drawn by a magnetic force to thereby cause the second cartridge electric contact to protrude from the sidewall.

17. The process cartridge of claim 14, wherein the roller comprises a photosensitive drum on which an electrostatic latent image is formed.

18. The process cartridge of claim 17, wherein the roller comprises a developing roller to supply a toner to the electrostatic latent image.

19. The process cartridge of claim 18, further comprising:

a mounting portion; and a developing cartridge comprising the developing roller, wherein the developing cartridge is attachable to and detachable from the mounting portion.

20. The process cartridge of claim 14, wherein the roller comprises a developing roller to supply a toner from the process cartridge to an electrostatic latent image formed on a photosensitive drum of the image forming apparatus.

* * * * *